US005202131A

United States Patent [19]

Emiljanow et al.

[11] Patent Number: 5,202,131

[45] Date of Patent: Apr. 13, 1993

[54] APPARATUS FOR MAKING METAL POWDER, WITH A SUPPLY TANK, A POURING LADLE AND A FALL SHAFT

[75] Inventors: Leo Emiljanow, Maintal; Franz Höhne, Bruchköbel; Wolfgang Schwarz, Geislitz, all of Fed. Rep. of Germany

[73] Assignee: Leybold Aktiengesellschaft, Hanau I, Fed. Rep. of Germany

[21] Appl. No.: 812,587

[22] Filed: Dec. 20, 1991

[30] Foreign Application Priority Data

Sep. 10, 1991 [DE] Fed. Rep. of Germany ..... 4129991

[51] Int. Cl.[5] ..... B22F 9/06; C22B 11/00

[52] U.S. Cl. ..... 425/7; 425/183; 425/185; 425/188; 264/12; 75/338; 75/339

[58] Field of Search ..... 425/7, 6, 183, 185, 425/188, 189, 453; 264/11, 12; 75/337, 338, 339, 355

[56] References Cited

U.S. PATENT DOCUMENTS 4,365,944 12/1982 Pajonk et al. ..... 425/7
4,897,111 1/1990 Jonsson et al. ..... 425/7
5,120,352 6/1992 Jackson et al. ..... 425/7

FOREIGN PATENT DOCUMENTS 3034677 4/1982 Fed. Rep. of Germany .
1348063 10/1987 U.S.S.R. ..... 425/6

*Primary Examiner*—Jay H. Woo
*Assistant Examiner*—Khanh P. Nguyen
*Attorney, Agent, or Firm*—Felfe & Lynch

[57] ABSTRACT

An apparatus for making metal powders has a supply tank (2) for the molten starting material, at least one exchangeable pouring funnel (11, 13), at least one atomizing nozzle (12, 14) and at least one fall shaft (7) disposed thereunder for the solidification of the metal powder product. A chamber (1) enveloping the supply tank and the pouring funnel is disposed on the fall shaft (7). To be able more easily to change the pouring funnel or funnels, the chamber (1) has in the area of the pouring funnel a closable lateral opening (15), at which a lock chamber (16) for the introduction of the at least one pouring funnel (11, 13) is placed. A car (24) is held on tracks (18, 19) and can be driven into the chamber (1) and fully retracted into the lock chamber (16), and on its bottom is fastened a number of atomizing nozzles (12, 14) corresponding to the number of the pouring funnels (11, 13). The pouring funnels (11, 13) can be set downwardly onto the cars. The fall shaft (7) is provided with a coupling device (50) which, when the coaxial component group including a pouring funnel (11, 13) and atomizing nozzle (12, 14) has been positioned over the fall shaft (7), produces a gas-tight connection between the fall shaft (7) and the atomizing nozzle (12, 14).

7 Claims, 4 Drawing Sheets 5
6
1a
1
2
3
4
15
17
16
13
2a
11
12
11
13
24
44
19
14
20
12
12a
18
14
14a
10
21
7
23
22
8
9

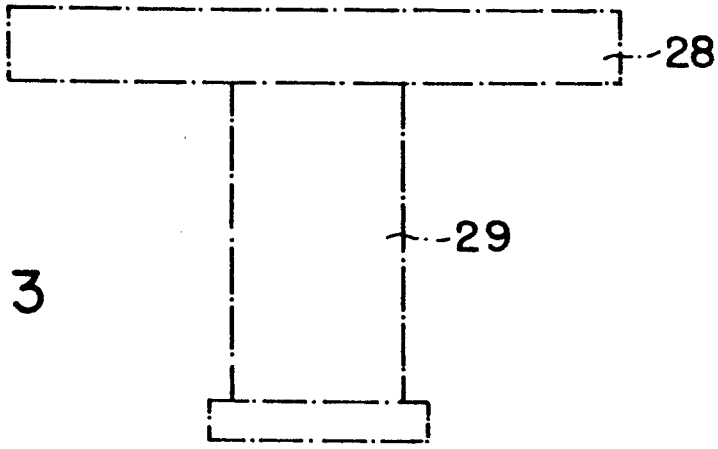
FIG. 3
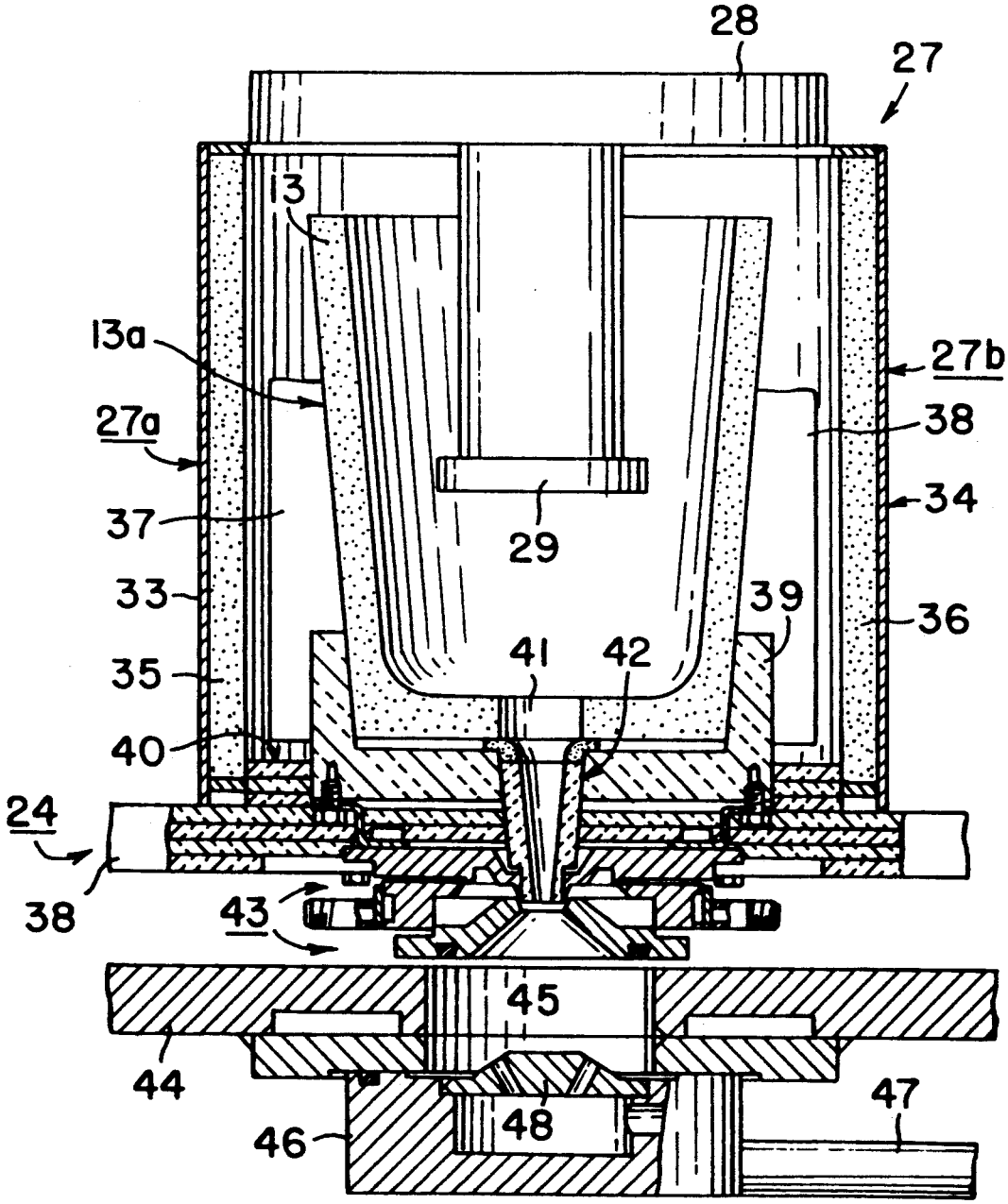

APPARATUS FOR MAKING METAL POWDER, WITH A SUPPLY TANK, A POURING LADLE AND A FALL SHAFT

BACKGROUND OF THE INVENTION

The invention relates to an apparatus for making metal powder, with a supply tank for keeping the molten starting material hot and for the controlled dispensing thereof, with a replaceable pouring funnel with outlet opening for the temporary gathering of the melt and the production of a pouring stream with a precisely defined cross section and length, with an atomizing nozzle having an annular slit and disposed concentrically with the opening of the pouring funnel, and with at least one substantially perpendicular fall shaft disposed under the atomizing nozzle for the solidification and collection of the met-al powder, wherein a chamber envelops the supply tank and the pouring funnel is disposed on the fall shaft, and can be separated hermetically from the fall shaft.

An apparatus of this kind is disclosed in German Patent 30 34 677; the pouring funnels are referred to therein as intermediate containers. The pouring funnels are needed for the production of thoroughly constant pouring and atomizing parameters, but on account of their ceramic internal surfaces they are subject to relatively great wear, so that they need to be replaced frequently. Constant pouring and atomizing conditions are necessary especially for the duration of the atomization of the metal of a charge, so that the powder material produced will have the same shape and a narrow range of grain sizes at the beginning and at the end of the atomization. In the known apparatus the pouring funnels can be replaced only after the supply chamber has been flooded and opened, which necessitates lengthy periods of stoppage of the apparatus. That is followed by evacuation periods of considerable length, because the fittings present in the chamber, especially the porous ceramic materials, absorb appreciable amounts of air and water vapor which greatly prolong the evacuation process.

The invention is therefore addressed to the problem of devising an apparatus of the kind described above, in which the pouring funnel is replaceable in a simple manner without exposing the rest of the apparatus to air, and in which a precise positioning of the pouring funnel and atomizing nozzle is made possible.

The solution of the stated problem is achieved in accordance with the invention, in the apparatus described above, by the fact that the chamber containing the supply tank and the pouring funnel has in the area of the pouring funnel a closable lateral opening at which a lock chamber is placed for the introduction of the at least one pouring funnel, that the chamber and the lock chamber have tracks aligning the chamber and the lock chamber with one another and interrupted only by a first closing device, on which a car is disposed which can selectively enter the chamber and be withdrawn completely into the lock chamber and on whose bottom a number of atomizing nozzles corresponding to the number of pouring funnels is fastened, and on this car the pouring funnels can be placed such that an outlet spout underneath the outlet opening can be inserted with guidance concentrically into the annular atomizing nozzle, the fall shaft being provided with a coupling system which, after the positioning of the group of components consisting of pouring funnel and atomizing nozzle over the fall shaft, produces the thoroughly gas-tight connection between fall shaft and atomizing nozzle.

SUMMARY OF THE INVENTION

In accordance with the invention, apparatus for making metal powder comprises a supply tank for keeping molten starting material hot and for controlled dispensing thereof, an exchangeable pouring funnel with an outlet opening for the temporary gathering of the melt and the production of a pouring stream of a precisely defined cross section and length, an atomizing nozzle having an annular slit and disposed concentrically with the opening of the pouring funnel, and at least one substantially perpendicular fall shaft disposed under the atomizing nozzle for the solidification and collection of metal powder, and a chamber enveloping the supply tank and the pouring funnel and disposed on the fall shaft and separatable hermetically from the fall shaft, the chamber having in the area of the pouring funnel a closable lateral opening, a lock chamber placed thereat for the introduction of the at least one pouring funnel, the chamber and the lock chamber having tracks aligning the chamber and the lock chamber with one another and interrupted only by a first closing device, a car disposed on said tracks and which selectively enters the chamber and withdraws completely into the lock chamber and on whose bottom a number of atomizing nozzles corresponding to the number of pouring funnels is fastened, an adjoining outlet spout which is inserted concentrically into the atomizing nozzle, and on the car the pouring funnels being placed such that an outlet opening communicates with the adjoining outlet spout, the fall shaft being provided with a coupling system which, after the positioning of the group of components comprising pouring funnel and atomizing nozzle over the fall shaft, produces a thoroughly gas-tight connection between fall shaft and atomizing nozzle.

For a better understanding of the invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings.

DESCRIPTION OF THE PREFERRED EMBODIMENT

Figure 1:
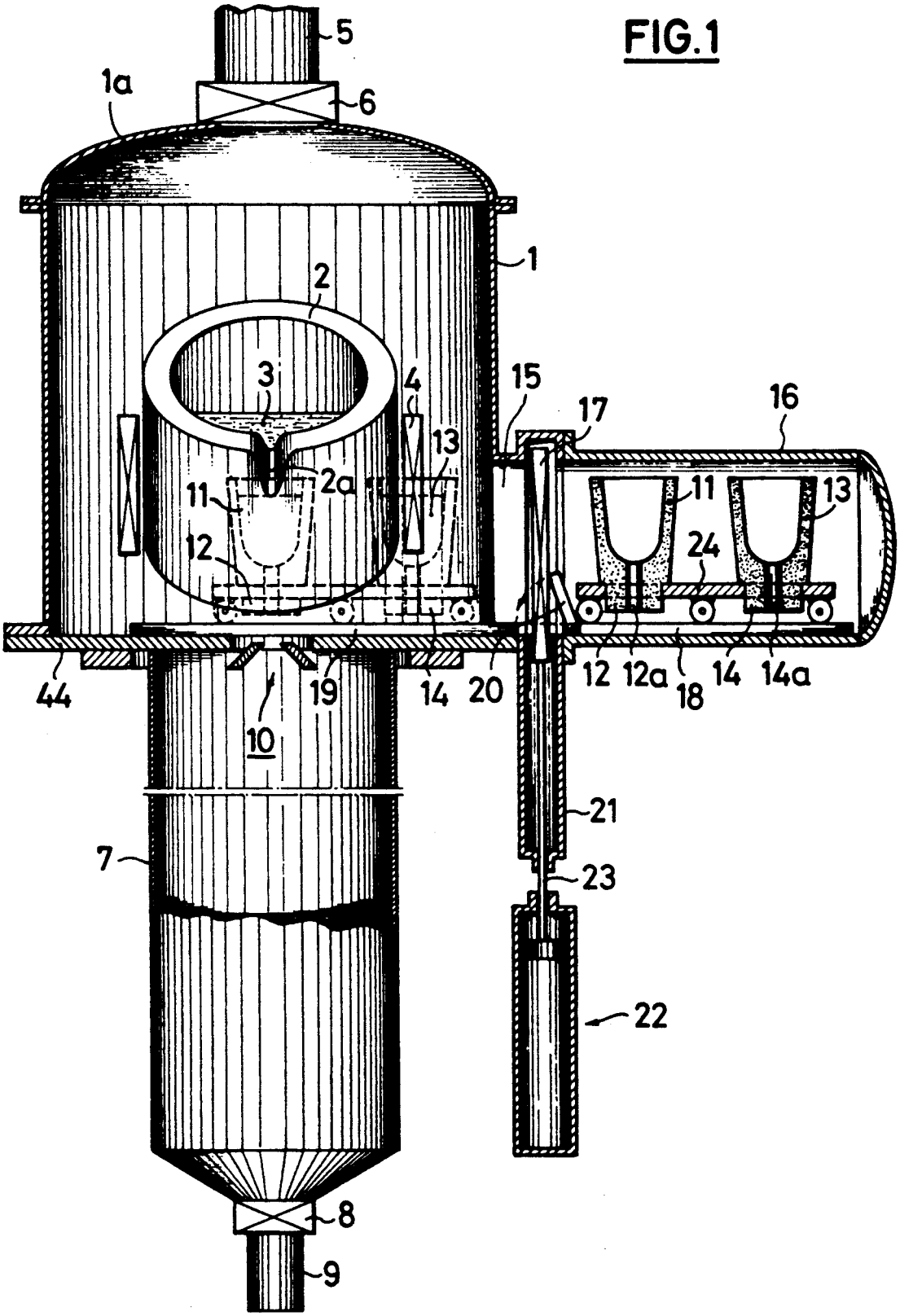
FIG. 1 is a sectional view, partly diagrammatic, vertically through a complete apparatus for the production of metal powder, FIG. 2 an enlarged, fragmentary view, partly diagrammatic, taken through a horizontal section of the apparatus of FIG. 1 in the area of the pouring position of the pouring funnel, FIG. 3 a sectional view, partly diagrammatic, taken vertically through a pouring funnel and an atomizing nozzle in a heating station.

In FIG. 1 there is shown a chamber 1 which contains a supply tank 2 for a melt 3 from which the metal powder is to be made, and an induction coil 4 for heating the supply tank 2. A charging system 5 with a charging valve 6 is disposed on the roof 1*a* of the chamber 1 for charging the supply tank 2.

On its front side the supply tank 2 is provided with a pouring lip 2*a* which defines the pouring position to be further described below. The chamber 1 is connected to a vacuum pump (not shown), and if necessary also to a source of an inert gas if the pouring is to be done under shielding gas.

Underneath the chamber 1 is a vertical fall shaft 7 in which the atomized metal is made to solidify. At the bottom end of the fall shaft 7 is a shut-off valve 8 which is adjoined by a pipe 9 for the removal of the metal powder product. An atomizing device 10 is shown diagrammatically in FIG. 1.

Underneath the pouring lip 2*a* is a first pouring funnel 11 which is exchangeably placed on an atomizing nozzle 12, which likewise is indicated only diagrammatically. Laterally beside the first pouring funnel 11 is a second pouring funnel 13 in a Waiting position, which is exchangeably placed on an additional atomizing nozzle 14.

In the area of the pouring funnels 11 and 13 the chamber 1 is provided with a lateral opening 15 at which a lock chamber 16 is situated for the introduction of the pouring funnels 11 and 13. Chamber 1 and lock chamber 16 are separable from one another in a vacuum-tight manner by a shutter system 17.

The lock chamber 16 is provided on its bottom with tracks 18 which are in line with similar tracks 19 in the chamber 1, a connection being produced by bridges 20 when the shutter system 17 is in its open state.

This open state is produced by lowering the shutter 17 into a retraction chamber 21. The power for this is derived from a hydraulic cylinder 22 and a piston rod 23.

On the tracks 18 is a car 24 with the two atomizing nozzles 12 and 14 in which nozzle orifices 12*a* and 14*a* are located. The pouring funnels 11 and 13 are placed on these nozzles in a manner to be described below.

The pouring funnels and atomizing nozzles can be carried by the car 24 through the opening 15 into the position shown in broken lines on the left of the latter, in which they stand on the tracks 19. These tracks have such a length that the second pouring funnel 13 can also be brought to a position under the pouring lip 2*a*.

The operation of the apparatus of FIG. 1 is as follows: First, with the shutter system 17 open, the already preheated pouring funnel 11 is brought under the pouring lip 2*a*, and then the pouring and atomization of the melt can begin, as will be further explained in connection with FIG. 4. During this period the second pouring funnel 13 is brought to the necessary temperature. If the first pouring funnel 11 has become incapable of operating, the car 24 on the track 19 will be shifted leftward until the pouring funnel 13 is underneath the pouring lip 2. This pouring funnel can now be used until it finally wears out. As soon as pouring funnel 13 is also incapable of operating, the car 24 will be shifted to the position drawn in solid lines inside of the lock chamber 16. Then the shutter 17 is closed and after the opening of a door 25 (FIG. 2), the pouring funnels 11 and 13 can be taken out and replaced with new ones, which preferably are preheated.

Figure 2:
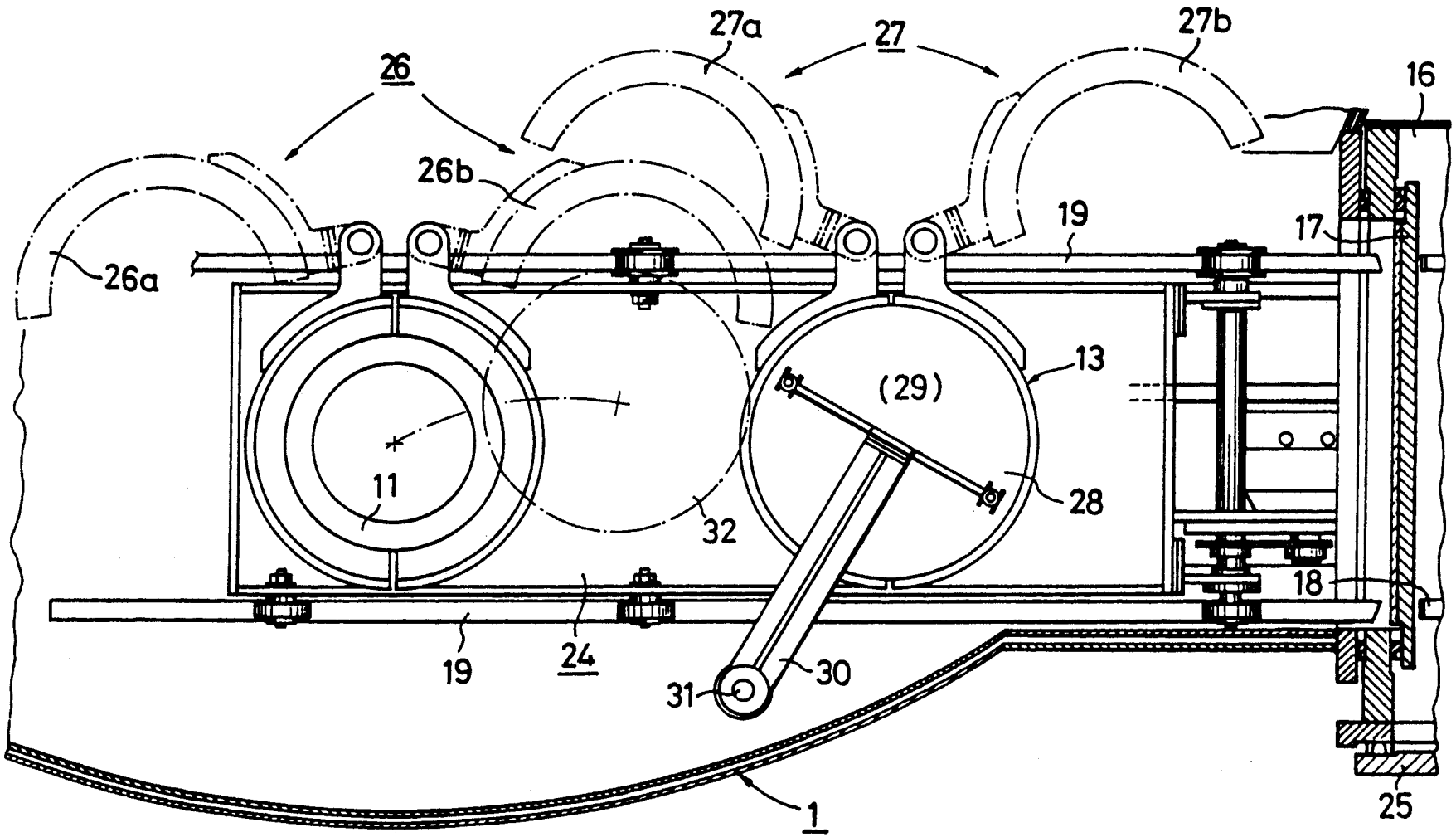

In FIG. 2 the same parts as in FIG. 1 are provided with the same reference numbers. It can be seen that the chamber is double-walled and a coolant can be made to flow through the interstice. The first pouring funnel 11 is in the pouring position underneath the pouring lip 2*a*, not shown here. In the chamber 1 are two heating apparatus 26 and 27, each consisting of two half-shells 26*a* and 26*b*, and 27*a* and 27*b*, which can be swung close to the pouring funnel after the corresponding pouring funnels 11 and 13 have entered. The broken lines indicate the heating apparatus in the open position. The second pouring funnel 13 is not visible in FIG. 2, because the cover 28 of an additional heating apparatus 29 is over it, as better seen in FIG. 3. The cover 28 is fastened on an arm 30 which can swing about a raising and turning axis 31. Through the arrangement shown in FIG. 2 of the heating apparatus 26, 27 and 29, it is possible to bring the pouring funnels 11 and 13 to an optimum working temperature before use. The heating apparatus 26 also -includes a similar cover 32 with the same kind of internal hearing apparatus 29, but this is not shown here for clarity.

FIG. 3 shows a vertical section through a second pouring funnel 13, while it is underneath the heating station 27. The two half-shells 27*a* and 27*b* have each an outer sheet-metal jacket 33 and 34 and an inner insulating lining 35 and 36, respectively, on each of which there is a cylindrically curved heating resistance 37 and 38, respectively. The dividing line between the two heating resistances 37 and 38 is not visible behind the pouring funnel 13.

Referring to FIG. 3, the car 24 has a platform 38 on which a centering body 39 with a tapered centering surface is fastened by screws (not shown). The pouring funnel 13 has a tapered outside surface 13*a*, which at its lower part is complementary to the tapered centering surface of the centering body 39. In this manner the pouring funnel 13 can be given a firm seating on the car 24. The centering body 39 is surrounded by a ring 40 consisting of three layers of insulating material, whose cylindrical outer surface serves as an abutment for the two half-shells 27*a* and 27*b*.

In the bottom of the pouring funnel 13 is an outlet opening 41 which communicates with an adjoining spout 42 which in turn is inserted into an annular atomizing nozzle 43. The atomizing nozzle 43, whose construction and operation are state of the art, is bolted to the bottom of the car 24, so that the centering body 39 with the spout 42 and the atomizing nozzle 43 form one structural unit which, after the insertion of the pouring funnel 13 and after the car 24 has moved into the pouring position, is immediately ready for operation. Of course, the half-shells of the particular heating apparatus have to be opened briefly and the heating body 29 raised and swung away laterally for this purpose.

The chamber 1 rests on a chamber floor 44 which is also shown in FIG. 3, and in which, underneath the atomizing nozzle 43, an opening 45 concentric therewith is present. This opening is closed from the bottom by a plate 46 which is rotatable about an axis lying outside of the drawing format by means of an arm 47, and it can also be raised and lowered. The arm 47 simultaneously serves as a pipe for carrying a cooling gas which is directed by a distributing plate 48 against the atomizing nozzle 43 so that the latter will suffer no damage during the heating period.

Figure 4:
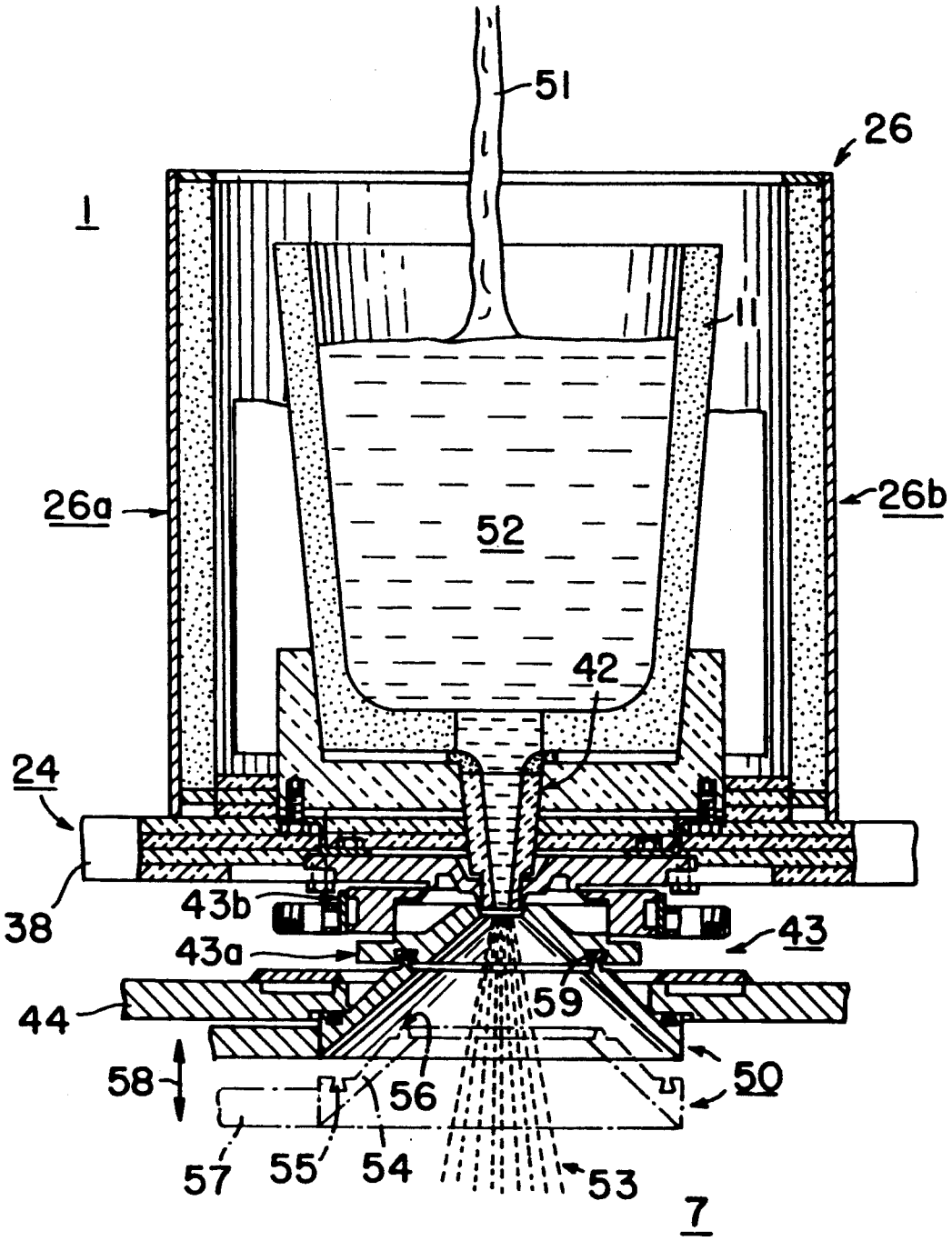
FIG. 4 is a sectional view, partly diagrammatic, taken vertically through pouring funnel and atomizing nozzle in the working position, i.e., during the production of powder.

FIG. 4 shows the arrangement according to FIG. 3, after the shift to the pouring position in which the atomizing of the melt is also performed. Parts that are the same as in the previous figures are provided with the same reference numbers.

A stream 51 falls from the pouring lip 2*a* of the supply tank 2 of FIG. 1. An amount of molten metal 52 thus collects in the pouring funnel 11 and serves to a certain extent as a buffer for the formation of a constant flow of molten metal from the spout 42.

The bottom end of the outlet nozzle 42 is disposed concentrically in the atomizing nozzle 43, which is bolted to the bottom of the platform 38 of car 24. The atomizing nozzle comprises a bottom part 43*a* and an upper part 43*b* surrounding chamber for an inert gas under pressure. The nozzle parts 43*a* and 43*b* surround a concentric central opening not indexed by number and also form an annular gap concentric with the central opening for the discharge of a hollow gas stream which converges toward the central axis and breaks up the molten stream into the molten particles 53.

Details of the atomizing process are state of the art, so they require no further discussion.

Below the molten stream 51 there is also an opening in the chamber floor 44 concentric with the outlet spout 42 and with the atomizing nozzle 43, under which or in which there is a coupling device 50 which is represented in its lowermost position (broken lines) and in its uppermost position (solid lines).

The coupling device 50 comprises a hollow conical coupling ring 54 which is provided on its outer circumference with a sealing ring 55 and on its inner circumference with a sealing knife-edge 56. The coupling ring 54 is fastened on an arm 57 by which it can be rotated about its axis, but principally can be raised and lowered in the direction of the double arrow 58.

In the raised position according to FIG. 4, the sealing ring 55 is in contact with the periphery of the opening in the chamber floor 44, while at the same time the sealing knife-edge 56 engages another sealing ring 59 which is situated in the bottom of the atomizing nozzle 43.

It can be seen in FIG. 4 that, when the atomizing nozzle 43 is raised, the coupling ring 54 hermetically seals against the chamber floor 44 and in doing so simultaneously interrupts the connection between the chamber 1 and the fall shaft 7, with the exception in any case of the outlet spout 42, which, however, prevents any gas exchange by the molten charge. After the coupling ring 54 is lowered to the position shown in broken lines, the car 24 with the two pouring funnels 11 and 13 and the two corresponding atomizing nozzles is shifted to the right and enters into the lock chamber 16, where the exchanging of the pouring funnels already described can be performed.

The pouring funnel described in the application has a very decisive function as regards keeping the pouring and atomizing parameters constant. It is virtually impossible to produce with the supply tank 2 a pouring stream which could have a position precisely concentric with the atomizing nozzle. Neither is it possible with a stream in free-fall from the pouring lip 2*a* to establish a constant rate of flow (per unit time), which is essential to a constant and continuous interaction between the atomizing gas and the molten stream. The pouring funnel therefore must perform the important task of producing together with the corresponding outlet spout a stream with a precisely defined cross section and path. This function of the pouring funnel diminishes as wear increases, so that a relatively frequent exchange of the pouring funnels is desirable. On account of the difficulties involved in the refilling of such pouring funnels, however, their time of use has been extended beyond the limits of the possible, so that the quality of the powder has had to suffer Since the subject matter of the invention permits a rapid exchange of the pouring funnels, this is a direct contribution to the improvement of powder quality.

Due to the mobility of the pouring funnels, however, an indirect contribution to the improvement of powder quality can be made, namely by the fact that the pouring funnels can be brought successively into interaction with various heating systems, so that even the temperature of the pouring funnels can be set at optimum levels. A good control of the temperature of the pouring funnels not only improves the maintenance of the fusion temperature parameter, but also improves the useful life of the crucibles, since temperature shocks can be largely avoided.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Apparatus for making metal powder comprising:

a supply tank for keeping molten starting material hot and for controlled dispersing thereof, an exchangeable pouring funnel with an outlet opening for the temporary gathering of melt and the production of a pouring stream of a precisely defined cross section and length, an atomizing nozzle having an annular slit and disposed concentrically with the opening of the pouring funnel, and at least one substantially perpendicular fall shaft disposed under the atomizing nozzle for the solidification and collection of metal powder, and a chamber enveloping the supply tank and the pouring funnel and disposed on the fall shaft and separatable hermetically from the fall shaft, the chamber having in the area of the pouring funnel a closable lateral opening, a clock chamber place thereat for the introduction of the at least one pouring funnel, the chamber and the lock chamber having tracks aligning the chamber and the lock chamber with one another and interrupted only by a first closing device, a car disposed on said tracks and which selectively enters the chamber and withdraws completely into the lock chamber and on whose bottom a number of atomizing nozzles corresponding to the number of pouring funnels is fastened, an adjoining outlet spout which is inserted concentrically into the atomizing nozzle, and on the car the pouring funnels being placed such that an outlet opening communicates with the adjoining outlet spout, the fall shaft being provided with a coupling system which, after the positioning of the group of components comprising pouring funnel and atomizing nozzle over the fall shaft, produces a thoroughly gas-tight connection between fall shaft and atomizing nozzle.

2. Apparatus according to claim 1, which includes in the chamber at least one heating device which can be brought into thermal exchange with the pouring funnel brought into working position.

3. Apparatus according to claim 2, in which if two pouring funnels and two atomizing nozzles are disposed on the car and in the chamber two heating devices are disposed, each of which can be brought into thermal exchange with the corresponding pouring funnel.

4. Apparatus according to claim 2, in which the heating device comprises two half-shells which can be swung into the vicinity of the pouring funnel after the corresponding pouring funnel has been introduced.

5. Apparatus according to claim 1, in which between the chamber and the lock chamber the closing device is disposed parallel to the axis of the fall shaft and, after the introduction of the car with the at least one pouring funnel into the working position, one of the two pouring funnels can be locked in its open position.

6. Apparatus according to claim 5, which includes, between the tracks aligned with one another, bridging members which are swung away out of the path of movement of the closing device by the closing device in its movement into closing position, and upon its movement to open position can be brought into such a position that they steplessly connected together top edges of the tracks.

7. Apparatus according to claim 4, which includes, in addition to the half-shell-like heating devices, an additional heating body for each pouring funnel, and a heat-containing cover fastened to the heating body such that the ulterior of the pouring funnel can also be heated in a heating-up phase.

* * * * *